US010211016B2

(12) United States Patent
Haehnel et al.

(10) Patent No.: US 10,211,016 B2
(45) Date of Patent: Feb. 19, 2019

(54) ARRANGEMENT FOR AN ELECTRICAL SWITCH ELEMENT, IN PARTICULAR A CONTACT OR RELAY, AND ELECTRICAL SWITCH ELEMENT HAVING A CONTROL MODULE BETWEEN THE YOKE MEMBER AND COIL

(71) Applicant: TE Connectivity Germany GmbH, Bensheim (DE)

(72) Inventors: Thomas Haehnel, Berlin (DE); Albert Koetter, Berlin (DE); Christian Maranke, Luechfeld (DE); Rene Wagner, Berlin (DE); Titus Ziegler, Berlin (DE); Tobias Marschner, Berlin (DE)

(73) Assignee: TE Connectivity Germany GmbH, Bensheim (DE)

( * ) Notice: Subject to any disclaimer, the term of this patent is extended or adjusted under 35 U.S.C. 154(b) by 572 days.

(21) Appl. No.: 14/943,586

(22) Filed: Nov. 17, 2015

(65) Prior Publication Data

US 2016/0071675 A1 Mar. 10, 2016

Related U.S. Application Data

(63) Continuation of application No. PCT/EP2014/061005, filed on May 28, 2014.

(30) Foreign Application Priority Data

May 31, 2013 (DE) ..... 10 2013 210 193

(51) Int. Cl.
*H01H 47/00* (2006.01)
*H01H 50/16* (2006.01)
(Continued)

(52) U.S. Cl.
CPC ..... *H01H 50/16* (2013.01); *H01H 47/00* (2013.01); *H01H 47/02* (2013.01); *H01H 47/22* (2013.01); *H01H 50/04* (2013.01)

(58) Field of Classification Search
CPC ..... H01H 50/16
See application file for complete search history.

(56) References Cited

U.S. PATENT DOCUMENTS 4,344,103 A * 8/1982 Nagamoto ..... H01H 51/24 335/133
5,191,306 A * 3/1993 Kaji ..... H01H 50/16 335/128

(Continued)

FOREIGN PATENT DOCUMENTS

CN 2482737 Y 3/2002
CN 101017748 A 8/2007

(Continued)

OTHER PUBLICATIONS

English translation of Chinese First Office Action, dated Sep. 28, 2016, 16 pages.

(Continued)

*Primary Examiner* — Stephen W Jackson
(74) *Attorney, Agent, or Firm* — Barley Snyder

(57) ABSTRACT

An electrical switch element is disclosed. The electrical switch element has a coil member, a yoke having at least one yoke member, and a control module. The control module is disposed between the coil member and the yoke member.

19 Claims, 3 Drawing Sheets

(51) Int. Cl.

| | |
|---|---|
| ***H01H 47/02*** | (2006.01) |
| ***H01H 50/04*** | (2006.01) |
| ***H01H 47/22*** | (2006.01) |

(56) References Cited

U.S. PATENT DOCUMENTS

| | | | |
|---|---|---|---|
| 5,959,519 | A | 9/1999 | Gobel et al. |
| 6,233,131 | B1 | 5/2001 | Kappel et al. |
| 2010/0033276 | A1 | 2/2010 | Niimi et al. |

FOREIGN PATENT DOCUMENTS

| | | | |
|---|---|---|---|
| EP | 1903581 | A2 | 3/2008 |
| GB | 2183095 | A | 5/1987 |
| JP | 1-286222 | A | 11/1989 |
| JP | 2001-135519 | A | 5/2001 |
| JP | 2008-28321 | A | 2/2008 |
| JP | 201040418 | A | 2/2010 |
| WO | 2008080301 | A1 | 7/2008 |

OTHER PUBLICATIONS

Chinese First Office Action, dated Sep. 28, 2016, 12 pages.
Abstract of CN101017748, dated Aug. 15, 2007, 2 pages.
Abstract of CN2482737, dated Mar. 20, 2002, 1 page.
English translation of CN101017748, dated Aug. 15, 2007, 6 pages.
Japanese Notice of Reasons for Refusal and English translation, dated Dec. 20, 2017, 17 pages.
PCT International Search Report and Written Opinion, International Application No. PCT/EP2014/061005, dated Aug. 8, 2014, 7 pages.
Abstract of WO2008080301(A1), dated Jul. 10, 2008, 2 pages.

* cited by examiner

ARRANGEMENT FOR AN ELECTRICAL SWITCH ELEMENT, IN PARTICULAR A CONTACT OR RELAY, AND ELECTRICAL SWITCH ELEMENT HAVING A CONTROL MODULE BETWEEN THE YOKE MEMBER AND COIL

CROSS-REFERENCE TO RELATED APPLICATIONS

This application is a continuation of PCT International Application No. PCT/EP2014/061005 filed May 28, 2014, which claims priority under 35 U.S.C. § 119 to German Patent No. 102013210193.7 filed May 31, 2013.

FIELD OF THE INVENTION

The invention relates to an electrical switch element, and more particularly, to an electrical switch element having a coil member, a yoke, and a control module for electrically controlling the switch element.

BACKGROUND

Electrical switch elements, for example, monostable contactors or relays in electric vehicles/hybrid vehicles, often have a control module which at least partially controls the switch element. For example, the control module may reduce the control power after the switching operation has been released. This may be carried out by pulse width modulation or switching of a low-resistance operating winding to a higher-resistance switch winding.

If the high starting power levels which are required for switching and which are necessary for starting the switching operation are limited to the operating time of the switch element, the power necessary to retain the switch element in the switched position may be limited. The energy reversal in the relay is thereby reduced and the thermal input by the magnetic coil into the environment substantially reduced. Consequently, it is possible, when a control module is used, to reduce the structural space required for the coil member and to decrease the drive system necessary for driving the switch element.

SUMMARY

The object of the invention is to further reduce the size of the electrical switch elements and conserve structural space. The disclosed electrical switch element has a coil member, a yoke having at least one yoke member, and a control module. The control module is disposed between the coil member and the yoke member.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
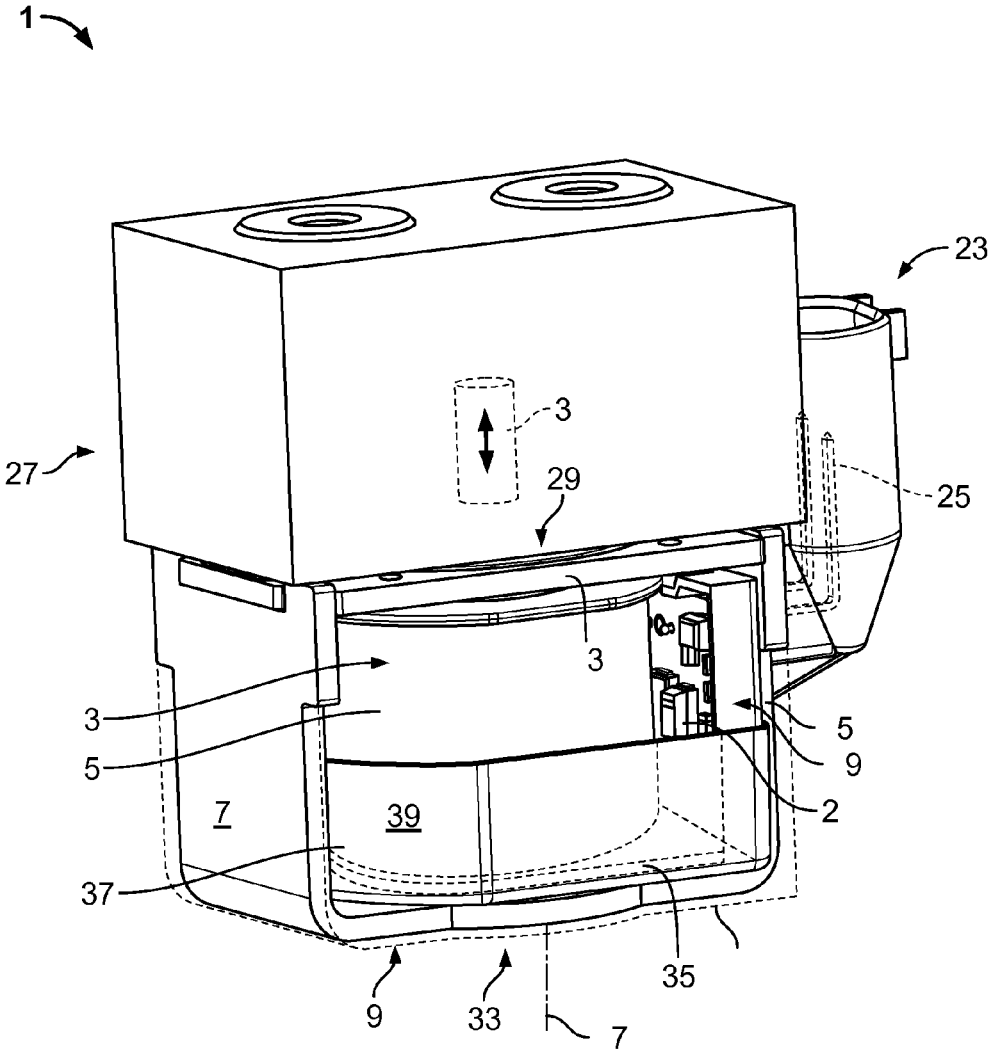
FIG. 1 is a perspective view of a switch element according to the invention.

The invention is explained in greater detail below with reference to embodiments of an electrical switch element.

This invention may, however, be embodied in many different forms and should not be construed as limited to the embodiments set forth herein; rather, these embodiments are provided so that this disclosure will be thorough and complete and still fully convey the scope of the invention to those skilled in the art.

An electrical switch element 1 according to the invention will be described with reference to FIG. 1. The electrical switch element 1 has a coil member 3, a yoke 7, a control module 19, a connection 23, a contact chamber module 27, and an insulation cap 37. The major components will now be described in greater detail.

Figure 2:
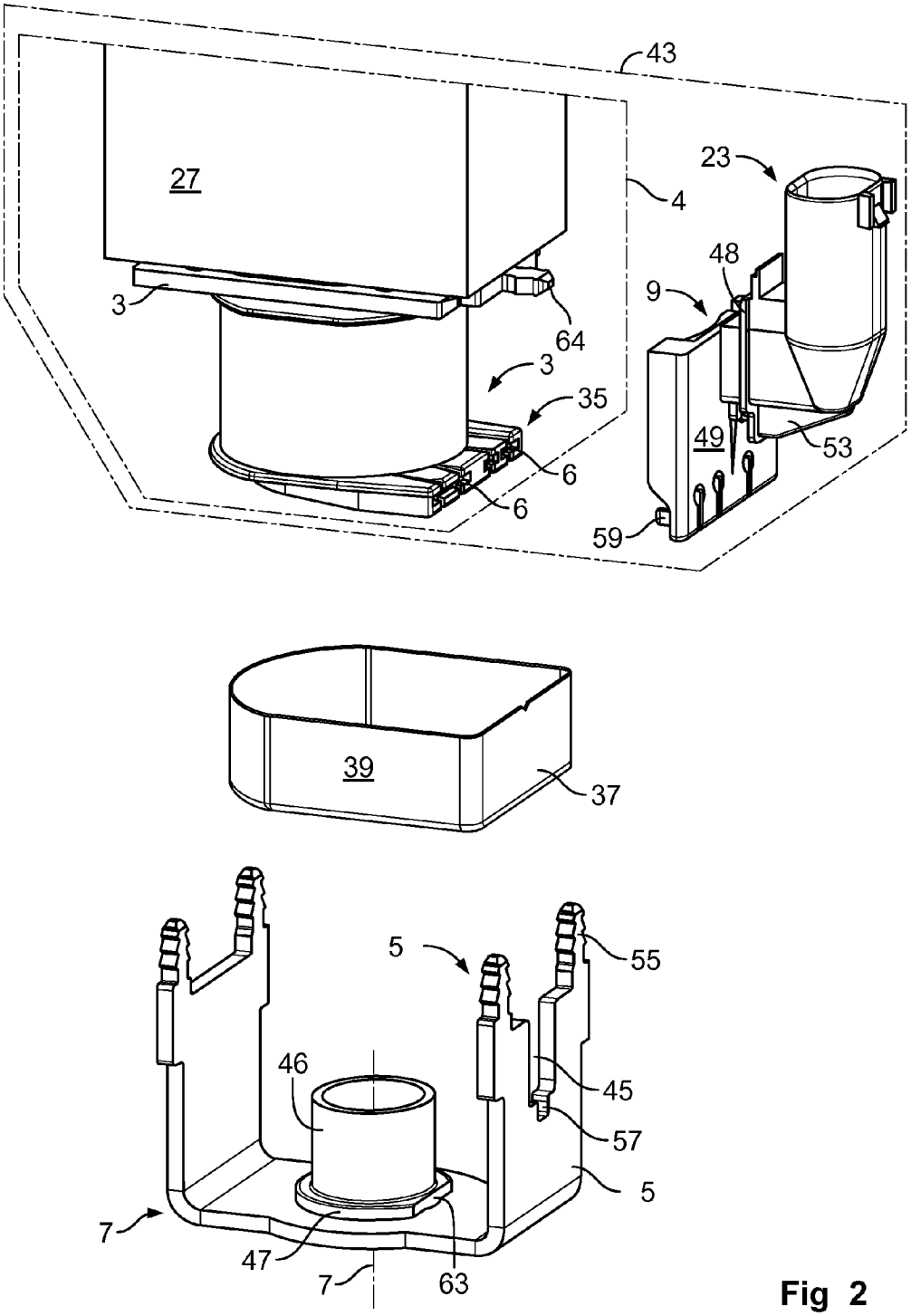
FIG. 2 is a exploded view of the switch element of FIG. 1.

The coil member 3, as best shown in FIG. 2, is an elongated body. In the exemplary embodiment of FIG. 2, the coil member 3 is a cylindrical member. The coil member 3 is provided with an assembly flange 35, which projects at a proximal end of the coil member 3 in a direction perpendicular to the coil member 3. The assembly flange 35 has complementary connection elements 61 at a distal end thereof, which have an installation length 62 in the direction perpendicular to the longitudinal axis 17 shown in FIG. 2. A coil 5, as shown in FIG. 1, is wound on the coil member 3. The coil member 3 also has a drive element 31 extending from a distal front side 29 of the coil member 3.

The yoke 7 will be described with reference to FIGS. 1 and 2. The yoke 7 is a u-shaped body which may have a rectangular base face 9 and in particular a parallelepipedal cubature 11. A socket 46 may protrude into the interior of the yoke 7 from the base face 9 of the yoke. The socket 46 may have a peripheral abutment flange 47 at the base thereof. The abutment flange 47 is approximately bead-like and projects radially from the socket 46. At least one yoke member 15 extends parallel to the protrusion of the socket 46. The yoke member 15 is provided at the free end 51 with fixing elements 55, and has a recess 45. The recess 45 is provided with a receiving member 57 which is constructed so as to correspond to the projection 53, and is open to the free end 51. The receiving member 57 extends in the displacement direction. The yoke 7 may be closed by a separate yoke plate 13, shown in FIG. 1, which may also belong to the yoke 7 in an integral manner in alternative embodiments. The yoke plate 13 may include a fixing element 64 extending from the outer perimeter thereof, as shown in FIG. 2.

Figure 3:
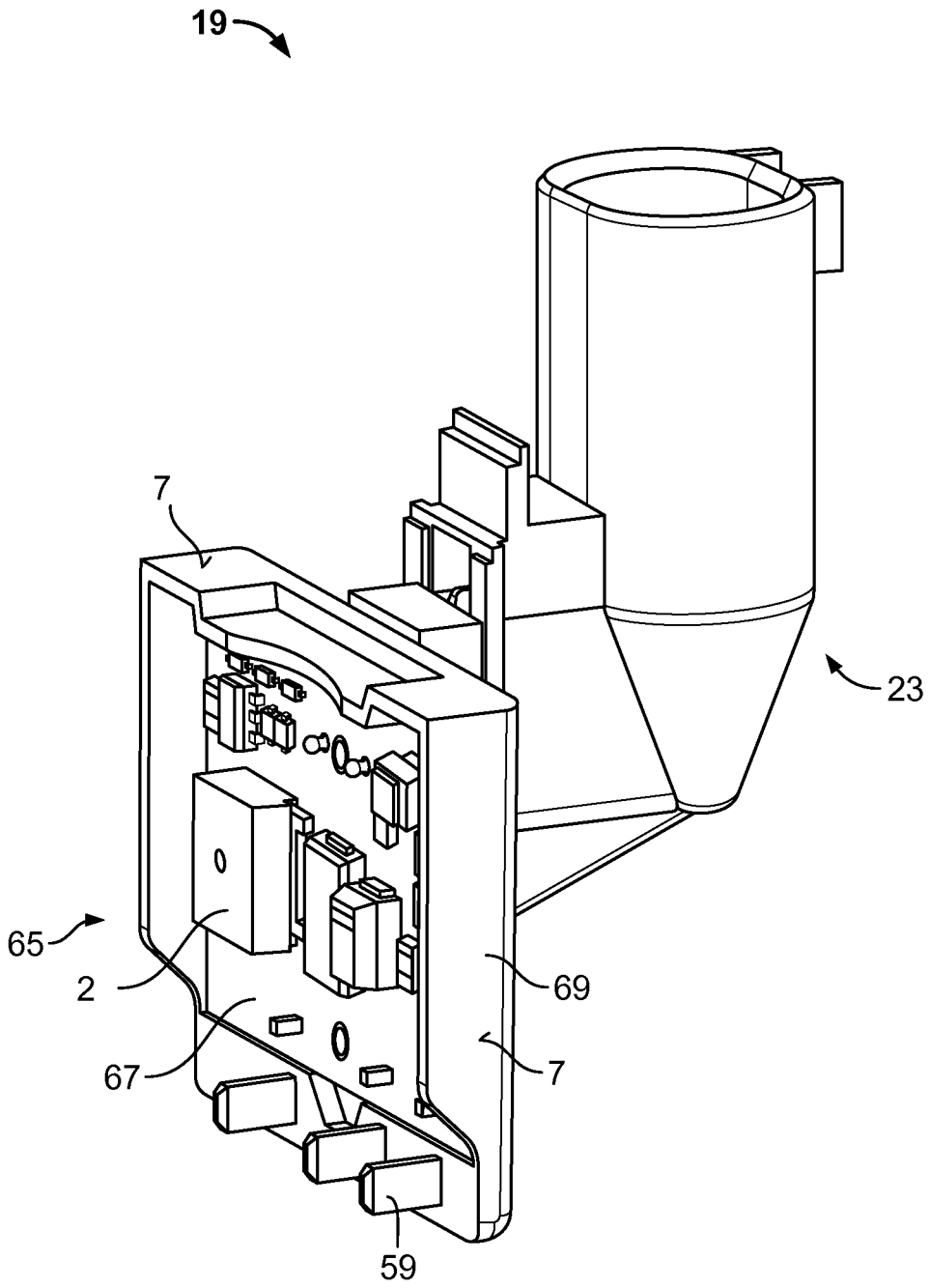
FIG. 3 is a perspective view of a switch module according to the invention.

The control module 19 will be described with reference to FIGS. 2 and 3. The control module 19 may have a pocket 65 which receives at least one printed circuit board 67. In an alternative embodiment, the control module 19 and printed circuit board are integrally formed in a preassembled assembly unit. To this end, the printed circuit board is retained in a one-piece carrier 73, which is optionally injection-moulded from plastics material and which also forms the connection 23. Electrical structural elements 21 are arranged on the printed circuit board 67. The pocket 65 has at least at three side protection walls 69, 71 which project beyond the printed circuit board 67. The control module 19 may have a guiding and retaining collar 48, as best shown in FIG. 2, and a rear wall 49. As can further be seen in FIG. 2, the control module 19 is provided with electrical connection elements 59 which extend away from the rear wall 49. The electrical connection elements 59, for example, are blade-like contact blades. The control module 19 is used to electrically control the switch element 1, for example, in order to limit a switching current in terms of time and/or magnitude.

The connection 23 will now be described with reference to FIGS. 1 and 2. The connection 23 of the control module 19 may be constructed in a plug-like manner; in the exemplary embodiment shown in FIGS. 1 and 2, the body of the connection 23 is formed in a cylindrical and cone shape. The interior space of the connection 23 is provided with terminals 25, as shown in FIG. 1. The connection 23 forms a rib-shaped projection 53 along the outside body thereof.

The contact chamber module 27, as shown in FIGS. 1 and 2, may be a parallelepiped body.

The insulation cap 37 includes a peripheral wall 39. The insulation cap 37 is optionally formed as a cup-like body, as shown in FIG. 2.

The connections of the electrical switch element 1 according to the invention will now be described in greater detail with reference to FIGS. 1 and 2.

The coil member 3 is received in the cubature 11 of the yoke 7. The coil member 3 is positioned such that the assembly flange 35 projects in the direction of the control module 19 or the yoke member 15. The assembly flange 35 does not overlap the coil 5 transversely relative to the longitudinal direction 17 of the coil member 3 so that it can be wound. When connected with the yoke 7, the assembly flange 35 may extend perpendicularly with respect to the yoke members 15, as FIG. 1 shows. The socket 46 projects into the interior of the coil 5 or the coil member 3 when the switch element 1 is completely assembled.

The control module 19 is arranged between the coil member 3 and the yoke 7, in particular the yoke member 15 thereof. The control module 19 may be arranged completely inside the cubature 11 of the yoke 7. From the outer side of the yoke, the control module 19 can be electrically contacted via the connection 23.

In the direction of the longitudinal axis 17 shown in FIG. 1, the contact chamber module 27 adjoins the yoke 7 on a side of the yoke plate 13. The contact chamber module 27 receives the switch contacts (not shown) of the electrical switch element 1, which contacts are intended to be switched and which are moved by means of the drive element 31, which can be driven by the coil 5 and extends into the interior of the contact chamber module 27.

The insulation cap 37 is positioned at the front side 33, at which the control module 19 is electrically connected to the coil member 3. The coil member 3 and the control module 19 are arranged in the insulation cap. The insulation cap is used to increase the creep current paths between the yoke 7 and the connection between the assembly flange 35 and the coil member 3.

When the control module 19 is mounted, the guiding and retaining collar 48 extends parallel with the plane of the yoke member 15 into which it protrudes in a peripheral manner so as to be directed away from the control module. As FIG. 1 shows, the yoke member 15 is between a rear wall of the control module 19 and the guiding and retaining collar 48 in the definitive assembly position. The guiding and retaining collar 48 may adjoin the yoke member 15 externally.

The control module 19 may be displaceably received in the recess 45, in the direction of the longitudinal axis 17 of the coil member 3. In particular, the definitive assembly position is reached after displacing the control module 19 along the recess 45. The recess 45 may open in the direction towards a free end 51 of the yoke member 15. This allows the control module 19 to be pushed along the recess into the definitive assembly position from above in the direction of the longitudinal axis 17 of the coil member 3. The guiding and retaining collar 48 further supports the control module 19 so that forces acting on the control module are directed into the stable yoke 7.

Furthermore, the control module 19 can further be supported by the projection 53. The projection 53 advantageously extends in the direction in which the control module 19 is displaceable in the recess 45. In the present embodiment, this is the direction of the longitudinal axis 17, with other directions also being possible. The displaceability in the direction of the longitudinal axis 17 has the advantage that the yoke member 15 is not weakened by the recess 45, in particular when it opens outwards, because the yoke member 15 is provided at the free end 51 with fixing elements 55 which engage in the yoke plate 13. In such an embodiment, the recess 45 is provided with a receiving member which is constructed so as to correspond to the projection 53. The receiving member 57 extends in the displacement direction of the control module 19 away from the recess 45. The projection 53 is thus also a retention element as a result of the positive-locking connection with respect to the recess 45.

The control module 19 is electrically connected to the coil member 3 via the assembly flange 35. The connection elements 59 extend to the side facing the coil member 3, and matingly connect with the complementary connection elements 61. The complementary connection elements 61 of the assembly flange 35 contact the coil wire(s) of the coil 5 (not shown) directly, for example, via insulation displacement connections. Furthermore, the assembly flange and the control module may be connected to each other via additional fixing elements, for example, catch connections. Alternatively, the connection elements 59, 61 may also produce an adequate retention force.

If the length 62 of the complementary connection elements 61 is large, a flattened portion 63 on the socket 46 and/or the abutment flange 47 may have to be provided in order to provide space for the complementary connection elements 64. Alternatively or additionally, for example, the wall thickness of the socket and/or abutment flange may be reduced at the sides opposite the complementary connection elements.

In order not to unnecessarily load the assembly flange 35, however, it is advantageous for the mechanical connection between the coil member 3 and the control module 19 to be brought about via the yoke 7, in particular the yoke plate 13. The catch projection 64 of the yoke plate 13 may project such that the mechanical connection between the control module 19 and the yoke 7 or coil member 3 occurs outside the yoke 7. In the embodiment of FIG. 2, the fixing element of the control module 19 complementary to the fixing element 64 of the yoke plate 13 is arranged in the region of the connection 23, that is to say, outside the yoke 7 in the definitive assembly position.

During connection, the printed circuit board 67 is oriented parallel with the yoke member 15 and the longitudinal axis 17. Merely by way of example, the pocket 65 opens in FIG. 3 towards the coil member 3 so that the printed circuit board can be positioned in the coil member from this side. It is also conceivable for the pocket 65 to be closed at this location and the printed circuit board to be pushed through one of the narrow sides 71 into the pocket 65. The protection walls 69 are used to increase the creep current paths between the yoke member 15 and the printed circuit board 67. They further protect the structural elements 21 before the control module 19 is assembled.

The electrical switch element 1 may readily be mounted because it is constructed from a small number of preassembled assembly units which can be integrally handled. FIG. 2 shows this.

Accordingly, a first assembly unit 41 comprises the coil member 3 which is fitted to the contact chamber module 27. From this first assembly unit, a second assembly unit 43 is formed by fitting the control module 19 and is then introduced into the yoke 7. The insulation cap 37 may be inserted into the yoke 7 before the second assembly unit 43 is introduced, or also preassembled on the second assembly unit 43.

In a variant of this construction, the first assembly unit 41 may also be formed from the coil member 3 and the control module 19, the contact chamber module 27 being positioned on the first assembly unit 41 in order to form the second assembly unit 43.

What is claimed is:

1. An electrical switch element, comprising:

a coil member;

a yoke having at least one yoke member; and a control module; wherein the control module is disposed between the coil member and the yoke member and has a pocket having protection walls which extend away from the yoke member.

2. The electrical switch element according to claim 1, further comprising electrical structural elements positioned in the pocket.

3. The electrical switch element according to claim 2, further comprising electrical connection elements positioned on the control module and complementary connection elements positioned on the coil member, wherein the electrical connection elements matingly connect with the complementary connection elements.

4. The electrical switch element according to claim 3, further comprising an assembly flange attached to the coil member, the assembly flange connecting to the control module.

5. The electrical switch element according to claim 4, wherein the complementary connection elements are disposed on the assembly flange.

6. The electrical switch element according to claim 1, wherein the control module extends through a recess of the yoke to an outer side of the yoke.

7. The electrical switch element according to claim 6, wherein the control module is displaceably received in the recess.

8. The electrical switch element according to claim 7, wherein the recess opens toward a free end of the yoke member.

9. The electrical switch element according to claim 6, wherein the control module has at least one projection.

10. The electrical switch element according to claim 9, wherein the yoke has a complementary receiving member, and the projection of the control module extends through the complementary receiving member.

11. The electrical switch element according to claim 1, wherein the control module has a connection to terminals, the connection to terminals positioned outside the yoke.

12. The electrical switch element according to claim 1, further comprising an insulation cap positioned between the control module and the yoke.

13. The electrical switch element according to claim 1, further comprising a yoke plate having at least one fixing element.

14. The electrical switch element according to claim 13, wherein the fixing element mechanically connects with the control module.

15. The electrical switch element according to claim 1, wherein the coil member and control module are assembled as an assembly unit.

16. The electrical switch element according to claim 15, wherein the assembly unit is connected with the yoke.

17. The electrical switch element according to claim 1, wherein the yoke has a socket projecting from a base of the yoke into the yoke interior.

18. The electrical switch element according to claim 17, wherein the socket has a flange abutting the yoke base.

19. The electrical switch element according to claim 18, wherein the flange has a flattened portion opposite the yoke member.

* * * * *